US006584900B2

(12) United States Patent
De Vroome

(10) Patent No.: US 6,584,900 B2
(45) Date of Patent: Jul. 1, 2003

(54) DEVICE FOR CORRECTING THE LATERAL POSITION OF A PRINTING MATERIAL WEB IN A ROTARY PRESS

(75) Inventor: Clemens Johannes Maria De Vroome, Beugen (NL)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/738,600

(22) Filed: Dec. 16, 2000

(65) Prior Publication Data

US 2003/0010236 A1 Jan. 16, 2003

(51) Int. Cl.[7] ..... B41F 13/54

(52) U.S. Cl. ..... 101/228; 226/21; 198/807

(58) Field of Search ..... 101/228, 181; 400/619; 226/15, 18, 19, 21, 23, 27, 44; 198/807; 242/419.8

(56) References Cited

U.S. PATENT DOCUMENTS

| | | | | | |
|---|---|---|---|---|---|
| 3,380,637 | A | * | 4/1968 | Knapp | 226/21 |
| 3,554,423 | A | * | 1/1971 | Alexeff | 226/19 |
| 3,595,459 | A | * | 7/1971 | Colombo | 226/21 |
| 3,657,051 | A | * | 4/1972 | McCarthy | 101/228 |
| 4,129,238 | A | * | 12/1978 | Herd | 101/228 |
| 4,204,619 | A | * | 5/1980 | Damour | 226/21 |
| 4,214,524 | A | * | 7/1980 | Corse | 101/181 |
| 4,842,180 | A | * | 6/1989 | Kato | 226/190 |
| 5,074,450 | A | | 12/1991 | Lindner et al. | 226/21 |
| 5,117,969 | A | * | 6/1992 | Roth | 198/807 |
| 5,276,460 | A | * | 1/1994 | Miyajima | 226/21 |
| 5,285,726 | A | | 2/1994 | Ohta | 101/228 |
| 5,387,962 | A | | 2/1995 | Castelli et al. | 355/212 |
| 5,388,513 | A | | 2/1995 | Ohta | 101/228 |
| 5,419,509 | A | * | 5/1995 | Krayenhagen | 242/419.8 |
| 5,479,241 | A | * | 12/1995 | Hou et al. | 198/807 |
| 5,555,611 | A | * | 9/1996 | Lyczek | 26/102 |
| 5,558,263 | A | * | 9/1996 | Long | 226/15 |
| 5,667,123 | A | * | 9/1997 | Fukuda | 226/21 |
| 5,906,305 | A | * | 5/1999 | Knorr | 198/807 |
| 5,921,452 | A | * | 7/1999 | Wulf et al. | 226/21 |
| 6,105,899 | A | * | 8/2000 | Harris | 226/23 |
| 6,435,743 | B2 | * | 8/2002 | Kralles et al. | 226/21 |

FOREIGN PATENT DOCUMENTS

| | | |
|---|---|---|
| DE | 1039468 | 9/1958 |
| DE | 3125852 | 1/1983 |
| DE | 3915056 | 11/1990 |
| DE | 4224236 | 5/1993 |

* cited by examiner

*Primary Examiner*—Eugene H. Eickholt
(74) *Attorney, Agent, or Firm*—Davidson, Davidson & Kappel, LLC

(57) ABSTRACT

A device for correcting the lateral position of a printing material web (8) in a rotary press includes a correction roller (10), which is able to swivel over guide surfaces (26, 28) arranged at an angle to the web's direction of travel and roller elements (22, 24) cooperating with these, and including a web guide roller (16) arranged downstream when viewed in the web's direction of travel, over which the printing material web (8) is guided. The device (6) is characterized in that the guide surfaces (26, 28) are arranged with respect to the web's direction of travel such that the correction roller (10) moves on a substantially circular path having a radius that is large in comparison to the length of the correction roller (10) and having a center point, viewed in the web's direction of travel, which is situated in a web section (12) upstream from the correction roller (10).

20 Claims, 4 Drawing Sheets

DEVICE FOR CORRECTING THE LATERAL POSITION OF A PRINTING MATERIAL WEB IN A ROTARY PRESS

FIELD OF THE INVENTION

The present invention relates to a device for correcting the lateral position of a printing material web in a rotary press.

BACKGROUND OF THE INVENTION

In rotary presses, the problem arises that the position of a printing material that is printed in the printing units and dried, for example, in a dryer arranged downstream from the printing units needs to be corrected before the printing material enters into a downstream folder in the lateral direction, i.e., transversely to the web's direction of travel, in order to be able to compensate, for example, for a lateral displacement resulting from a disturbance caused when changing the reels.

In this regard, it is known from German Patent DE 31 25 852 C1, to guide the printing material web over two web guide rollers or correction rollers that are rotatably mounted in parallel with one another in a mutual frame, and to change the lateral position of the printing material web by tilting the frame away from its original position. Apart from the overall space requirements, another drawback of the device is that the location of the point of rotation near the center of the frame subjects the printing material web to considerable strain when the frame is tilted, so that web breakage can easily occur. As a rule, this results in a longer down time for the printing machine, thereby entailing a considerable loss of production.

German Patent Application DE 39 15 056 A1 purportedly describes a device for correcting the lateral position of a printing material web, where the printing material web is fed via a correction roller, which can swivel about a point of rotation and is guided in lateral guideways by way of roller elements, and via a web guide roller arranged downstream therefrom, to a festooning unit that is able to be charged with a partial vacuum, from where it is fed to a draw roller pair, which rests in a frame. The frame in which the draw roller pair is supported is coupled in articulated fashion to the correction roller by a journal arranged in the point of rotation of the correction roller and, itself, is able to swivel about a further point of rotation situated near one of the draw rollers such that, in response to the draw rollers being tilted in an opposite direction, the correction roller is tilted along with them (e.g., co-swivelled). In the case of this device as well, the swivel point of the correction roller is situated near the roller, which likewise subjects the printing material web to considerable strain.

SUMMARY OF THE INVENTION

Accordingly, an object of the present invention is to provide a device for correcting the lateral position of a printing material web in a rotary press, where the differences in the tensile stress acting on the printing material web in response to a lateral position correction are reduced, and the danger of web breakage is diminished. It is also an object of the present invention to devise a device for correcting the lateral position of a printing material web, where less overall space is required than in known methods heretofore.

In accordance with the present invention, a device for correcting the lateral position of a printing material web in a rotary press includes a correction roller, which is able to swivel over guide surfaces disposed at an angle to the web's direction of travel and roller elements cooperating with these guide surfaces. In this context, the guide surfaces are arranged with respect to the web's direction of travel such that, in response to the application of a laterally acting force, the correction roller moves on a circular path or on a substantially circular path having a radius that is large in comparison to the length of the correction roller and having a center point, viewed in the web's direction of travel, which is situated upstream from the correction roller, preferably near the middle of the printing material web, and which, at the same time, constitutes the point of rotation or swivel point of the correction roller. Downstream from the correction roller is also a web guide roller, which is preferably arranged in a stationary mount and which deflects the printing material web that is guided over the correction roller, for example, in the direction of other web guide rollers, cooling rollers, or angle bars.

A benefit of the device according to the present invention is that it requires substantially less overall space in comparison to known design approaches where two or more rollers are mounted, for example in a frame, so as to be able to swivel with respect to one another.

In addition, the design of the present invention offers the advantage that the swivel radius, which, for example, can be within the range of, for example, 7.5 m, given a 70 cm to 1 m long correction roller, can be changed very easily by altering the angle at which the guide surfaces are disposed with respect to the web's direction of travel. This can be achieved, for example, by installing a replacement, or by changing the inclination of the guide surfaces. In this manner, the device according to the present invention is able to be adapted very simply and cost-effectively to different types of printing machines, dryers or folders, depending on the printing machine section in which one intends to use the device according to the present invention.

In the preferred specific embodiment of the present invention, the correction roller and the web guide roller arranged downstream therefrom are preferably so arranged with respect to one another that the swivel plane of the correction roller runs essentially in a direction perpendicular to a web section running between the correction roller and the web guide roller. From this, one derives the advantage of an optimal translation of a lateral swivel motion of the correction roller into a lateral positional change of the printing material web, thereby effecting an efficient device response, particularly when working with large swivel radii. The device's effective response is also reinforced in the manner of the present invention in that the printing material web, on the one hand, is displaced by the lateral movement of the correction roller, as such, and on the other hand, as a reinforcement thereto, by the simultaneous tilting of the correction roller, so-to-speak in the "correct direction". In this case, the lateral change in position can be, for example, in the range of ±25 mm, i.e., altogether 50 mm.

In accordance with another preferred specific embodiment of the present invention, the printing material web in the web section arranged upstream from the correction roller runs essentially in parallel to the plane in which the correction roller is able to swivel, further enhancing the sensitivity of the device in accordance with the present invention.

In yet another specific embodiment of the present invention, the guide surfaces can have a circular curvature that corresponds to the curvature of the circular path, thereby better approximating the correction roller's circular motion than do flat guide surfaces, although the use of flat guide surfaces provides considerable advantages from a standpoint of production engineering.

Provision can also be made for the guide surfaces to be arranged, in pairs, on both sides of the correction roller, above and below the longitudinal axis of the correction roller, thereby ensuring, in particular in connection with essentially vertically running guide surfaces, a free-from-play, easy-motion and precise type of correction roller guidance on the one circular path or on a path substantially approximating a circular path.

A further advantage is derived from the vertical guide surface arrangement in that the correction roller is pressed solely by the tensile stress prevailing in the printing material web against the guide surfaces and is held against these surfaces, there being no need to use additional springs, pneumatic cylinders or other pressing elements, thereby substantially reducing outlay for devices, as well.

In connection with this specific embodiment of the present invention, it is particularly advantageous when the correction roller is braced in the vertical direction via other roller elements against support surfaces, which are preferably arranged in an essentially horizontally running plane and which take up the force due to weight of the correction roller. This ensures a precise and easy-action type of lateral motion of the correction roller.

The motion's easy action and precision is further enhanced by using conical or frustoconical tapered rollers as roller elements, whose conicity is selected so that the radius of the circular motion resulting from the conicity essentially corresponds to the radius of the correction roller's desired path of motion. In the same way, however, it is likewise conceivable, in place of conical tapered rollers, to use ball bearings or cylindrical rollers, as preferably used as well for the remaining guide surfaces.

Another specific embodiment of the device according to the present invention provides for the supporting surfaces to preferably be arranged at a distance from a perpendicular line running through the center of mass of the correction roller, to take up the force due to the weight of the correction roller. This enables the roller elements which are preferably mounted on the correction roller, in response to a preset web tension, to be pressed in opposition to a tilting moment acting on the correction roller, solely by the web tension, against the preferably vertically running guide surfaces in question. The tilting moment is produced in the process by the force due to weight acting at a distance from the supporting surfaces on the center of mass of the correction roller. It endeavors to tip the correction roller about an axis of tilt situated near the support points of the other roller elements on the horizontally running supporting surfaces.

One preferred specific embodiment of the present invention provides that the tilting moment produced in the previously described manner be used to interrupt the continued printing operation of the printing machine, in the event, for example, of breakage of the printing material web, and/or to activate a web interception device known from the related art. For this purpose, one can provide sensor means which cooperate with a control device of the printing machine to detect any tilting of the correction roller in response to decreased web tension, to force an emergency stop of the printing machine as previously described.

In an especially simple and reliable embodiment of the device according to the present invention, the sensor means include a circuit in which electric current flows over the roller elements and the guide surfaces assigned thereto, so that in the untilted state of the correction roller, i.e., given a proper web tension, the circuit is closed, and in the tilted state of the correction roller, i.e., given a web tension less than a predefined threshold value, the circuit is open. As a function of the current flow, for example via a control device connected to the circuit, the continued printing operation can be interrupted accordingly, and/or a web interception device can be activated.

Another specific embodiment of the present invention provides for the correction roller to be preferably rotatably accommodated by way of axle journals in bearing blocks, which are mounted laterally with respect to the correction roller, to which are rotatably secured the roller elements that cooperate with the essentially vertically running guide surfaces, as well as the additional roller elements that cooperate with the horizontally running supporting surfaces. Accordingly, in this specific embodiment of the present invention, the guide surfaces, as well as the supporting surfaces are secured to fixed frame parts of the device according to the present invention, which are preferably mounted on both sides of the correction roller. In the same way, however, it is likewise possible to arrange the roller elements on fixed frame parts of the device, and to form the guide surfaces on the bearing blocks. It is also possible to provide the guide surfaces both on the bearing blocks, as well as on the fixed frame parts, and to use free-wheeling balls or rollers between the guide surfaces.

Another specific embodiment of the present invention provides for the correction roller and/or the web guide roller to be designed as cooling rollers, which are traversed by the flow of a cooling agent, in a cooling section of a dryer of a rotary press, the cooling section preferably being integrated in the dryer of the rotary press. Due to the small space requirement resulting herefrom, it is advantageously possible to substantially reduce the overall length of a printing machine in comparison to drying and cooling sections that are configured separately, one behind the other, by using a device, which is likewise arranged downstream therefrom, to correct the lateral position of the printing material web.

Although the correction roller and/or the web guide roller in the specific embodiments of the present invention described above can have a non-driven, freely rotatable design, a motor-driven design is likewise possible.

In a further specific embodiment of the present invention, the correction roller is preferably moved laterally by an actuating device which acts on the rotating axis of the correction roller by way of a swivel joint. The actuating device can include a pneumatic or hydraulic cylinder, for example, or some other motor drive or roller-lever actuator, etc.

The ratio between the roller length and the radius of the circular path on which the correction roller moves can be, for example, in the range of 1:2 to 1:15, and depends, for example, on the length of the web section upstream from the correction roller, on the lateral path of motion of the correction roller, the printing speed, and the type of printing material, etc.

BRIEF DESCRIPTION OF THE DRAWINGS

The present invention is described in the following with reference to the drawing, on the basis of preferred specific embodiments. In the drawing, the figures show.

DETAILED DESCRIPTION OF THE PREFERRED EMBODIMENTS

Figure 1:
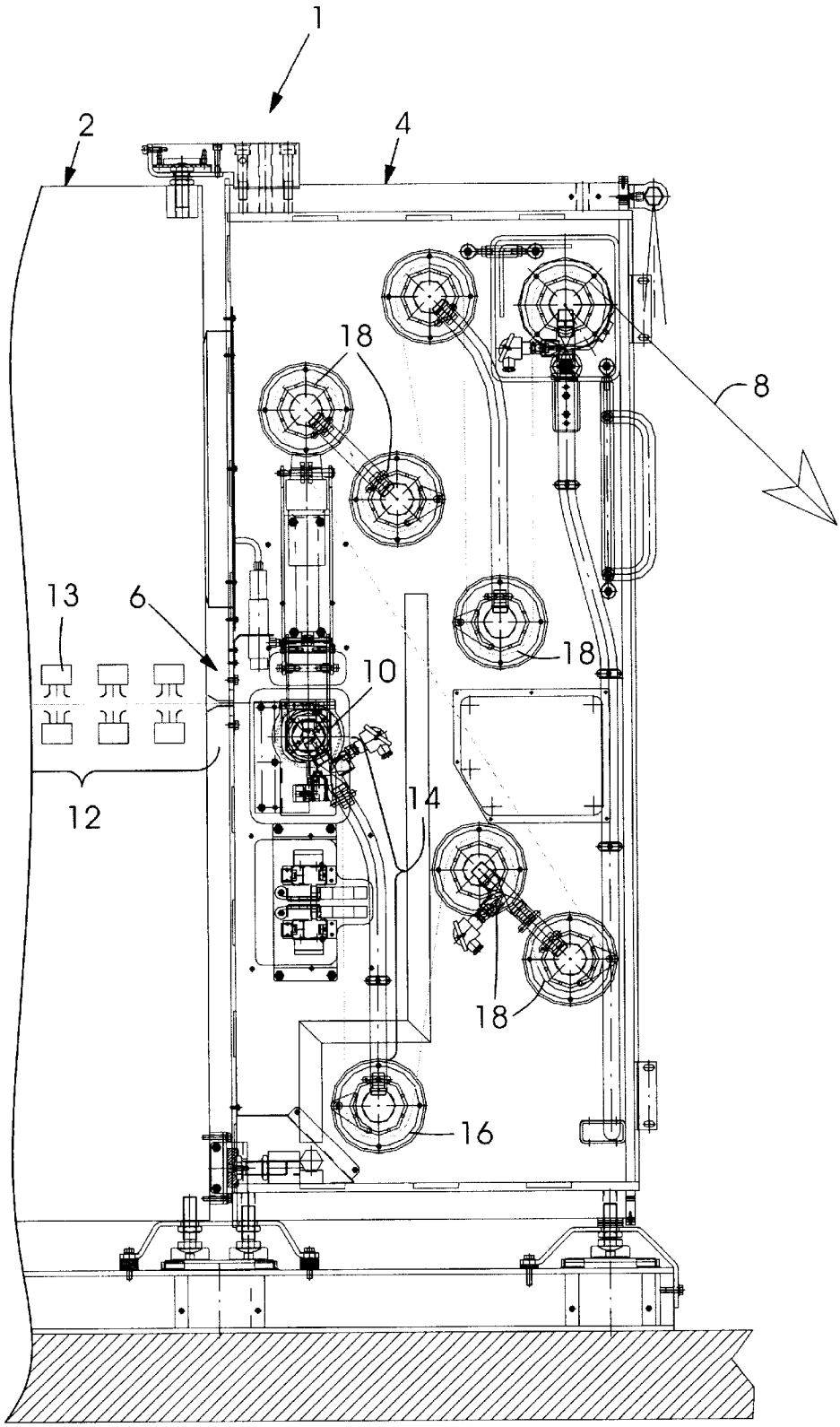
FIG. 1 a schematic representation of the driving side of a rotary press having a cooling section which includes a device in accordance with the present invention and which is integrated in the dryer.

FIG. 1 depicts a partial view of a rotary press 1, which includes a dryer section 2 and, downstream therefrom, a cooling section 4 having a device 6 according to the present invention mounted therein for correcting the lateral position of a printing material web 8 guided through rotary press 1.

As can be further inferred from FIG. 1, printing material web 8, coming from dryer 2, is guided along a prearranged web section 12, essentially horizontally, in the direction of a correction roller 10 contained in correction device 6 according to the present invention. Correction roller 10 deflects printing material web 8, and subsequently directs it along an essentially vertically running web section 14 downstream from correction roller 10 to a preferably fixed web guide roller 16, which again deflects printing material web 8 to feed it to other web guide rollers 18.

As can also be inferred from FIG. 1, in the specific embodiment of the present invention shown there, web guide roller 16, additional web guide rollers 18, and preferably correction roller 10 as well, are designed as cooling rollers. They cool down printing material web 8, which is still hot from being dried in dryer 2, for further processing in a downstream folder (not shown).

Figure 2:
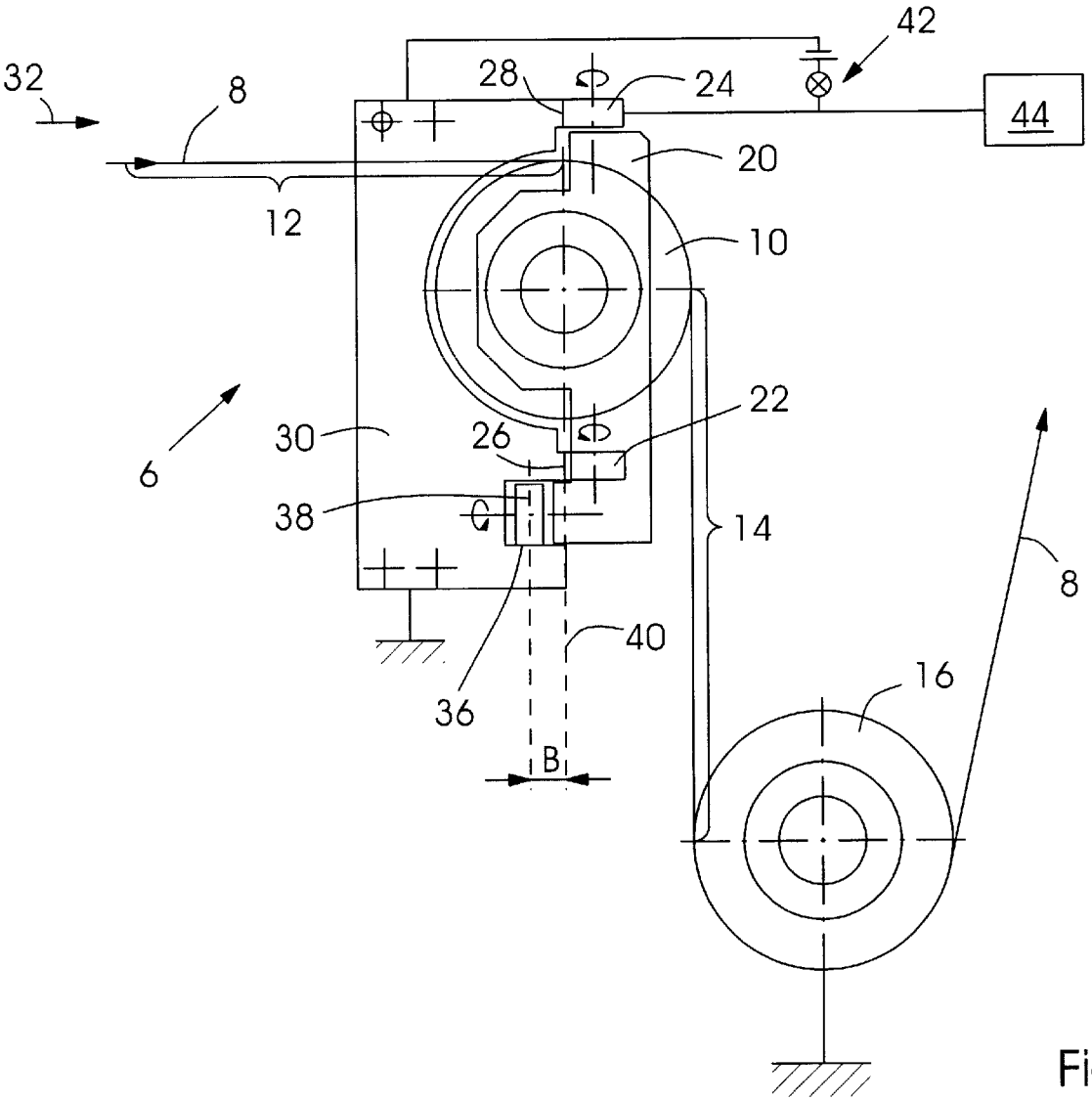
FIG. 2 an enlarged schematic side view of the device according to the present invention.
Figure 3:
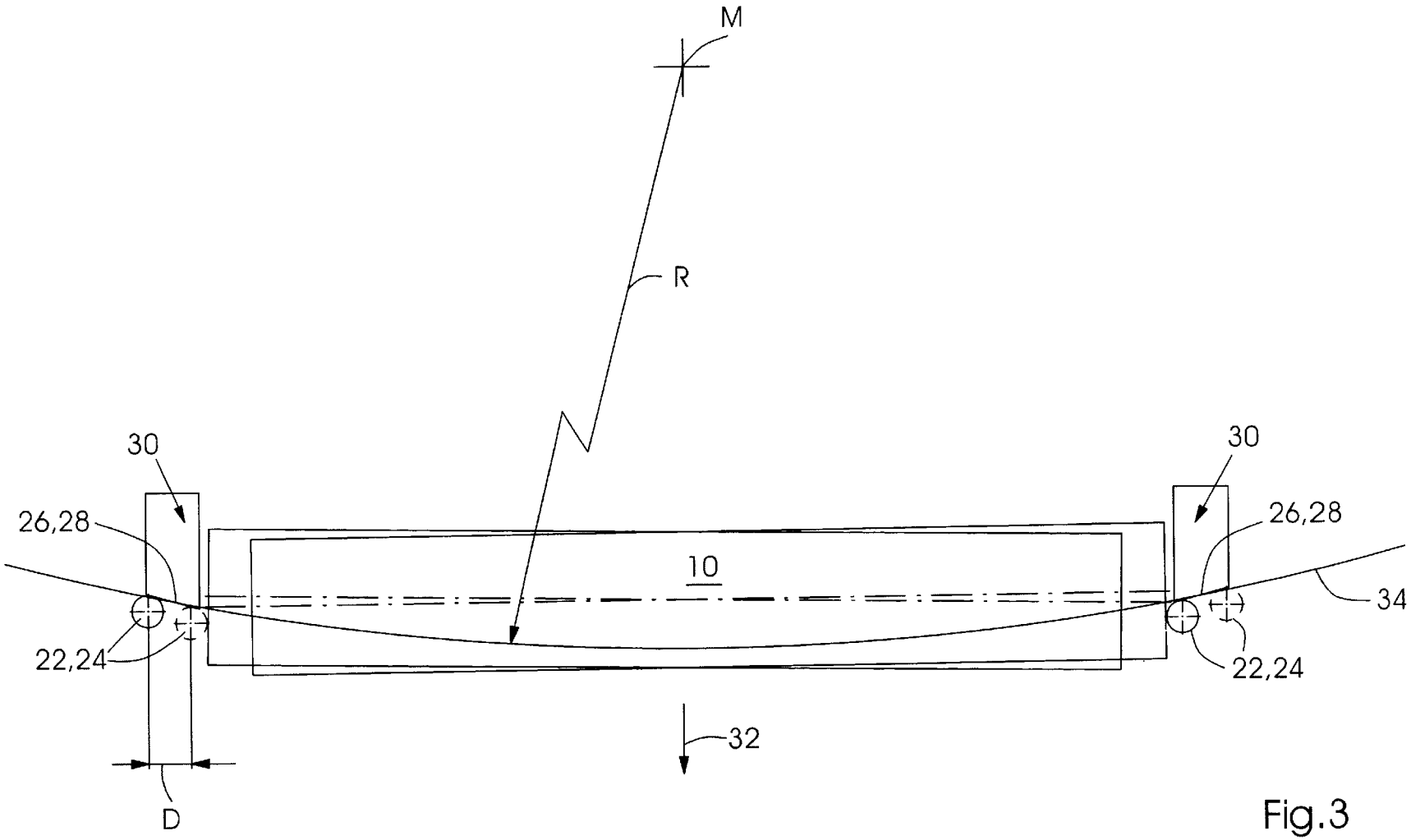
FIG. 3 a schematic plan view of the correction roller according to the present invention.
Figure 4:
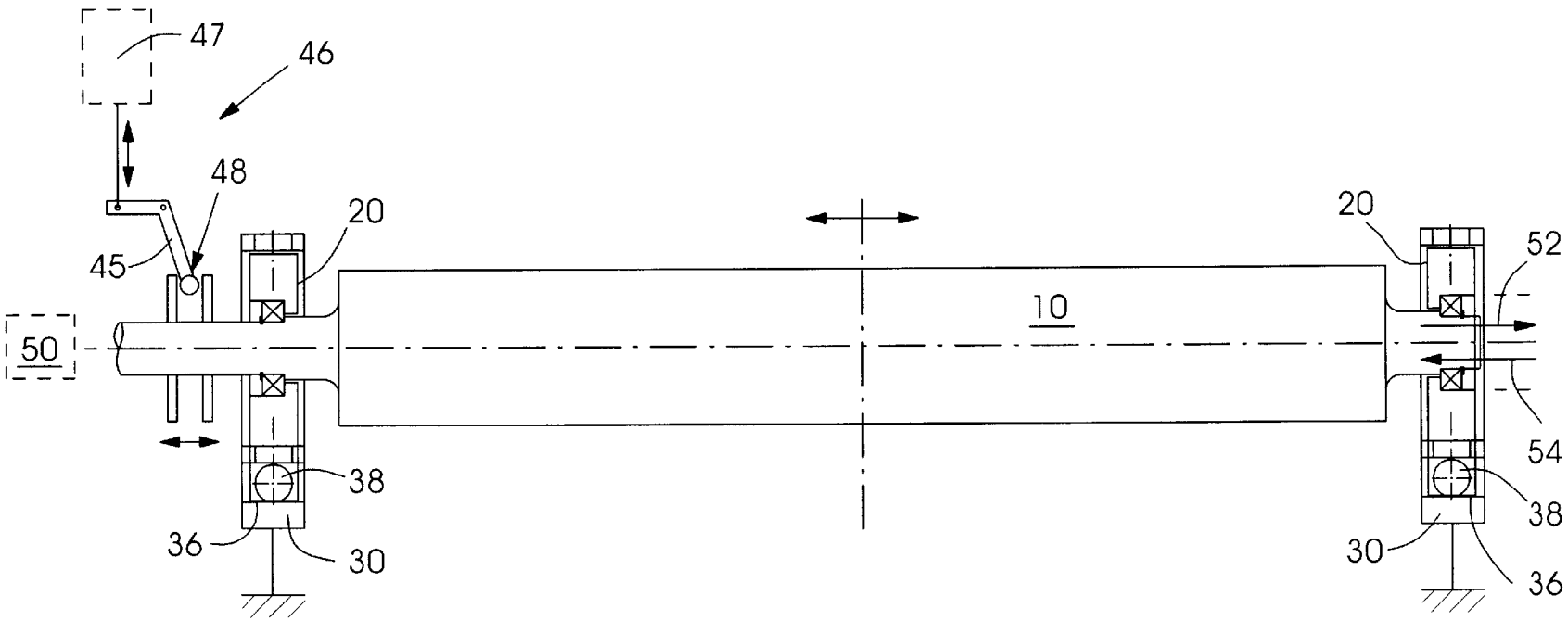
FIG. 4 a schematic front view of the correction roller according to the present invention which is rotatably supported in bearing blocks.

As shown in detail in FIGS. 2 through 4, correction roller 10 according to the present invention is rotatably supported by way of its axle journals in bearing blocks 20. Bearing blocks 20 are braced via bottom roller elements 22 rotatably arranged on each of bearing blocks 20 and preferably via top roller elements 24, as well, against guide surfaces 26 and 28, which are assigned to roller elements 22, 24. Guide surfaces 26, 28 are formed in fixed, side frame parts 30 of device 6 according to the present invention and run in an essentially vertical plane arranged at an angle to direction of travel of printing material web 8, as shown in FIGS. 2 and 3.

Given a sideways or lateral displacement D of, for example, ±25 mm on an essentially circular path 34, which, for example, at a length of correction roller 10 of 70 cm has a radius of curvature R in the range of 7.5 m, correction roller 10 moves through vertical guide surfaces 26, 28 arranged at an angle to direction of travel 32 of printing material web 8. In this context, midpoint M of the essentially circular path of motion 34 is situated in prearranged section 12 of correction roller 10, preferably near the center of the same. The swivel plane, in which correction roller 10 according to the present invention is swivelled about midpoint M of path of motion 34, preferably runs essentially in parallel to direction of travel 32 of printing material web 8 in prearranged web section 12.

To better illustrate the swivel motion, correction roller 10 in accordance with the present invention is depicted in FIG. 3 in the one swivel position by dotted lines and, in the other swivel position, by solid lines, the swivel positions shown representing the maximum side or lateral deflection position. The resultant total path D of the deflection is, for example, in the range of 50 mm.

As can also be inferred from FIG. 2, formed in the fixed side frame parts 30 underneath correction roller 10 are essentially horizontally running supporting surfaces 36, upon which roller 10 is supported by way of additional roller elements 38. Supporting surfaces 36—or strictly speaking, the support point of the other roller elements 38 on supporting surfaces 36—are arranged at a distance B from a perpendicular line 40 running through the center of mass of roller 10, so that a tilting moment produced by gravitational force acts on roller 10, is compensated during continued printing operation, given a taut printing material web 8, by the printing material web, and leads, in the case of a web breakage, to roller 10 being tilted about the support points of the other roller elements 38 on supporting surfaces 36. Distance B can amount, for example, to 5 mm and is selected as a function of the dimensions and the weight of correction roller 10, as well as of the web tension, etc.

In order to be able to utilize the tilting occurrence when top roller elements 24 become disengaged from corresponding guide surfaces 28, to ascertain a web breakage, sensor(s) 42 are provided, which contain an electric circuit, in which top roller elements 24 and corresponding guide surfaces 28 are linked as a switching contact, such that, in response to a tilted roller 10, the switching contact is opened, and in response to a properly resting roller 10, i.e., given a correct web tension, the switching contact is closed. Sensor(s) 42 are connected, e.g., to a control device 44 of printing machine 1, which, for example, in the event of a web breakage, i.e., an interruption of the current flow in the electric circuit, induces an emergency stop of printing machine 1, and/or activates a known web interception device.

As is furthermore shown in FIG. 4, the lateral motion of correction roller 10 is carried out via an actuating device 46, which includes a pneumatic cylinder 47, which acts by way of a lever 45 and a swivel joint 48 on the axis of rotation of correction roller 10, laterally displacing it.

As can furthermore be inferred from FIG. 4, roller 10 can be optionally driven by a motor 50 and/or additionally be designed as a cooling roller, which is indicated schematically by arrows 52 and 54 on the side of correction roller 10 opposing actuating device 46.

What is claimed is:

1. A device for correcting the lateral position of a printing material web in a rotary press, comprising a correction roller, the correction roller being swivelable over guide surfaces arranged at an angle to the web's direction of travel and roller elements cooperating with these, and a web guide roller arranged downstream of the correction roller, when viewed in the web's direction of travel, over which the printing material web is guided;

and wherein the guide surfaces are arranged with respect to the web's direction of travel such that the correction roller moves on a substantially circular path having a radius (R) that is large in comparison to a length of the correction roller and having a center point (M), which viewed in the web's direction of travel, is situated in a web section upstream from the correction roller.

2. The device as recited in claim 1, wherein the center point (M) is essentially arranged near a middle of the printing material web.

3. The device as recited in claim 1, wherein the correction roller and the web guide roller are arranged with respect to one another such that a swivel plane of the correction roller runs essentially in a direction perpendicular to a downstream web section running between the correction roller and the web guide roller.

4. The device as recited in claim 1, wherein, the printing material web in the web section arranged upstream from the correction roller runs essentially in parallel to the swivel plane of the correction roller.

5. The device as recited in claim 1, wherein, the guide surfaces have a circular curvature that corresponds to the curvature of the essentially circular path.

6. The device as recited in claim 1, wherein the guide surfaces run essentially vertically.

7. The device as recited in claim 1, wherein the guide surfaces are arranged, in pairs, on each side of the correction roller, above and below the longitudinal axis of the correction roller.

8. The device as recited in claim 1, wherein provision is made for supporting surfaces which run in an essentially horizontal plane and against which the correction roller is braced in the vertical direction via other roller elements.

9. The device as recited in claim 8, wherein the supporting surfaces are arranged at a distance (B) from a perpendicular line running through the center of mass of the correction roller, such that the roller elements assigned to the correction roller, in response to a preset web tension, are pressed in opposition to a tilting moment, produced by the gravitational force, solely by the web tension, against the guide surfaces assigned to the correction roller.

10. The device as recited in claim 9, wherein a sensor is provided, which detects any tilting of the correction roller resulting from the tilting moment produced by the force due to weight in response to decreased web tension, and that a control device is provided, which interrupts the continued printing operation of the printing machine as a function of the signals from the sensor means in response to a tilted correction roller.

11. The device as recited in claim 10, wherein the sensor includes a circuit connected to the guide surfaces and to the roller elements, which is closed in the untilted state of the correction roller and is opened in response to a reduction in the web tension in the tilted state of the correction roller.

12. The device as recited in claim 8, wherein the other roller elements have a frustoconical design.

13. The device as recited in claim 1, wherein the correction roller is rotatably accommodated in lateral bearing blocks, and wherein the roller elements are arranged on the bearing blocks, and at least one of the guide surfaces and the supporting surfaces are arranged on fixed frame parts of the device.

14. The device as recited in claim 1, wherein at least one of the correction roller and the web guide roller is a cooling roller which is traversed by the flow of a cooling agent, in a cooling section of a dryer of a rotary press.

15. The device as recited in claim 14, wherein the cooling section is integrated in the dryer of the rotary press.

16. The device as recited in claim 1, wherein at least one of the correction roller and the web guide roller is a motor-driven roller.

17. The device as recited in claim 1, wherein the lateral movement (D) of the correction roller is carried out by way of an actuating device which acts on the correction roller by way of a swivel joint.

18. The device recited in claim 13, wherein the guide surfaces and the supporting surfaces are arranged on fixed frame parts of the device.

19. The device of claim 14, wherein the correction roller and the web guide roller are cooling rollers.

20. The device of claim 16, wherein the correction roller and the web guide roller are motor-driven rollers.

* * * * *